US009845617B2

(12) United States Patent
Forsberg et al.

(10) Patent No.: US 9,845,617 B2
(45) Date of Patent: Dec. 19, 2017

(54) LOCK DEVICE AND ASSOCIATED METHOD, COMPUTER PROGRAM AND COMPUTER PROGRAM PRODUCT

(71) Applicant: ASSA ABLOY AB, Stockholm (SE)

(72) Inventors: Tomas Forsberg, Vaesteras (SE); Tomas Jonsson, Roenninge (SE)

(73) Assignee: ASSA ABLOY AB (SE)

( * ) Notice: Subject to any disclaimer, the term of this patent is extended or adjusted under 35 U.S.C. 154(b) by 0 days.

(21) Appl. No.: 15/111,299

(22) PCT Filed: Feb. 19, 2015

(86) PCT No.: PCT/EP2015/053507
§ 371 (c)(1),
(2) Date: Jul. 13, 2016

(87) PCT Pub. No.: WO2015/124674
PCT Pub. Date: Aug. 27, 2015

(65) Prior Publication Data

US 2016/0348400 A1 Dec. 1, 2016

(30) Foreign Application Priority Data

Feb. 19, 2014 (EP) ..... 14155783

(51) Int. Cl.
*E05B 47/00* (2006.01)
*G07C 9/00* (2006.01)

(52) U.S. Cl.
CPC ..... *E05B 47/0012* (2013.01); *G07C 9/00174* (2013.01); *E05B 2047/0048* (2013.01); *G07C 2009/00793* (2013.01)

(58) Field of Classification Search
CPC ..... E05B 2047/0048; E05B 47/0012; G07C 2009/00793; G07C 9/00174
See application file for complete search history.

(56) References Cited

U.S. PATENT DOCUMENTS 3,333,110 A * 7/1967 Schanne ..... G11C 27/04 327/277
3,337,744 A * 8/1967 Johnson ..... G05F 1/573 307/328

(Continued)

FOREIGN PATENT DOCUMENTS

EP 0 497 040 A1 8/1992
WO WO 00/77330 A1 12/2000

OTHER PUBLICATIONS

International Search Report and Written Opinion prepared by the European Patent Office dated Mar. 18, 2015 for International Application No. PCT/EP2015/053507.

(Continued)

*Primary Examiner* — Rita Leykin
(74) *Attorney, Agent, or Firm* — Sheridan Ross P.C.

(57) ABSTRACT

It is presented a lock device comprising: a controller configured to determine whether to open the lock device, wherein the controller is configured to provide an open signal when the lock device it to be opened, the open signal being a pulsating signal; a motor controllable to set the lock device in an open state or a closed state; and a motor driver connected between the controller and the motor, the motor driver comprising a capacitor providing a capacitive coupling between the controller and the motor, the motor driver being configured to provide a motor control signal to the motor to set the lock device in an open state only when a duty cycle of the open signal is less than a threshold duty cycle.

16 Claims, 4 Drawing Sheets

(56) References Cited

U.S. PATENT DOCUMENTS 3,573,621 A * 4/1971 Ulstad ..... H04L 27/26 375/242
4,922,224 A * 5/1990 Drori ..... B60R 25/1004 340/426.25
4,944,170 A * 7/1990 Jolidon ..... E05B 47/0012 70/267
5,061,923 A * 10/1991 Miller ..... G07C 9/00698 340/5.31
5,684,457 A * 11/1997 Miller ..... E05B 37/00 307/119
5,715,716 A * 2/1998 Miller ..... E05B 17/2084 292/144
5,841,361 A * 11/1998 Hoffman ..... E05B 47/00 340/5.54
5,912,631 A * 6/1999 Kusunoki ..... G07C 9/00182 307/10.2
5,917,691 A 6/1999 Kadah
6,108,188 A 8/2000 Denison et al.
6,185,773 B1 * 2/2001 Goedde ..... E05B 47/0012 340/10.1
6,586,898 B2 * 7/2003 King ..... H02P 6/182 318/400.04
6,911,897 B2 * 6/2005 Miller ..... E05B 37/00 340/5.55
7,042,192 B2 * 5/2006 Mehlhorn ..... F04D 15/0218 318/727
7,193,503 B2 * 3/2007 Fisher ..... G07C 9/00103 235/382
7,856,854 B2 * 12/2010 Simon ..... D06F 37/42 68/12.17
7,891,222 B2 * 2/2011 Ratkus ..... E05B 47/0012 70/278.7
9,080,349 B2 * 7/2015 Burrus ..... E05B 37/00
2012/0186964 A1 * 7/2012 Wan ..... H01H 71/10 200/501
2013/0255335 A1 * 10/2013 Jonely ..... E05B 47/0001 70/277
2014/0101864 A1 * 4/2014 Lee ..... D06F 33/02 8/137

OTHER PUBLICATIONS

International Preliminary Report on Patentability prepared by the European Patent Office dated Dec. 15, 2015 for International Application No. PCT/EP2015/053507.

* cited by examiner

LOCK DEVICE AND ASSOCIATED METHOD, COMPUTER PROGRAM AND COMPUTER PROGRAM PRODUCT

CROSS REFERENCE TO RELATED APPLICATIONS

This application is a national stage application under 35 U.S.C. 371 and claims the benefit of PCT Application No. PCT/EP2015/053507 having an international filing date of Feb. 19, 2015, which designated the United States, which PCT application claimed the benefit of European Patent Application No. 14155783.5 filed Feb. 19, 2014, the disclosures of each of which are incorporated herein by reference.

TECHNICAL FIELD

The invention relates to a lock device and associated method, computer program and computer program product for opening a lock device.

BACKGROUND

Access control systems based on electronic access are becoming more and more popular when needing to control access to a protected physical space. To gain access, a key device is provided in the proximity of, or in contact with, a lock device. Credentials of the key device are communicated between the key device and the lock device after which access is denied or granted. When access granted, a mechanical device needs to be controlled using electric signals to set the lock device in an open state to allow access to the protected physical space. Many times, this involves actuating a motor.

However, the signal provided to the motor should be secure from failure of components and/or external impact, such as lightning or external manipulation of voltage and/or temperature. Any improvement in such protection is an improvement of the security of the whole access control system.

SUMMARY

It is an object to provide improved protection for motor control in a lock device.

According to a first aspect, it is presented a lock device comprising: a controller configured to determine whether to open the lock device, wherein the controller is configured to provide an open signal when the lock device it to be opened, the open signal being a pulsating signal; a motor controllable to set the lock device in an open state or a closed state; and a motor driver connected between the controller and the motor, the motor driver comprising a capacitor providing a capacitive coupling between the controller and the motor, the motor driver being configured to provide a motor control signal to the motor to set the lock device in an open state only when a duty cycle of the open signal is less than a threshold duty cycle. The capacitive coupling provided between an input and an output of the motor driver prevents a pure direct current (DC) signal on the input from reaching the output. In this way, should the controller fail, e.g. due to internal fault or external impact, and a constant high DC signal is provided to the motor driver, this will not result in the motor being operated, which improves security and reliability of the lock device. The external impact can for instance be due to lightning or external manipulation of voltage and/or temperature. Moreover, since the duty cycle of the open signal needs to be less than a threshold duty cycle, an attack over a power interface is limited in the energy transferred to the motor by the threshold duty cycle.

A signal with the threshold duty cycle may be insufficient to activate the motor. In this way, an attacker is prevented from activating the motor, since a duty cycle less than the threshold duty cycle is required to send the signal to the motor, but the same duty cycle is not sufficient.

The motor driver may be configured such that an decreased duty cycle of the open signal results in an increased duty cycle of the motor control signal. This can easily be controlled by a functioning controller, but for an attacker, the same duty cycle is provided to both the motor driver and the motor, thus reducing energy transfer to the motor.

The open signal may be a pulse width modulated, PWM, signal. PWM signals are often readily available in controllers and are suitable for use as a pulsating signal.

The controller may comprise a watchdog timer periodically restarted by a main part of the controller when in normal operational state, wherein the watchdog timer is configured to reset the controller when it expires. This provides added reliability of the lock device.

The motor may be a DC motor. DC motors can be made small and at low cost, making them suitable for lock devices.

The lock device may further comprise a key device interface; and the controller may be configured to determine whether to open the lock device for a key device communicating with the key device interface.

The key device interface may comprise a radio frequency interface for communicating with key devices.

The key device interface may comprise a galvanic electrical connection for communicating with key devices.

According to a second aspect, it is presented a method for opening a lock device. The method being is performed in the lock device and comprises the steps of: determining whether to open the lock device; providing an open signal to a motor driver of the lock device when it is determined to open the lock device, the open signal being a pulsating signal; and providing a motor control signal to the motor to set the lock device in an open state only when a duty cycle of the open signal is less than a threshold duty cycle.

The open signal may be a pulse width modulated, PWM, signal.

The method may further comprise the steps of: periodically restarting a watchdog timer when the controller is in a normal operational state; and resetting the controller when the watchdog timer expires.

The method may further comprise the step of: communicating with a key device using a key device interface; in which case the step of determining whether to open the lock device is based on the result of the communication with the key device.

The step of communicating with a key device may comprise the use of a radio frequency interface to the key device.

The step of communicating with a key device may comprise the use of a galvanic electrical connection with the key device.

According to a third aspect, it is presented a computer program for controlling access. The computer program comprises computer program code which, when run on a lock device, causes the lock device to: communicate with a key device using a key device interface; determine whether to grant access for the key device communicating with the key device interface; when access is granted, provide an open signal to a motor driver of the lock device the open signal being a pulsating signal; and provide a motor control signal to the motor to set the lock device in an open state only when a duty cycle of the open signal is less than a threshold duty cycle.

According to a fourth aspect, it is presented a computer program product comprising a computer program according to the third aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
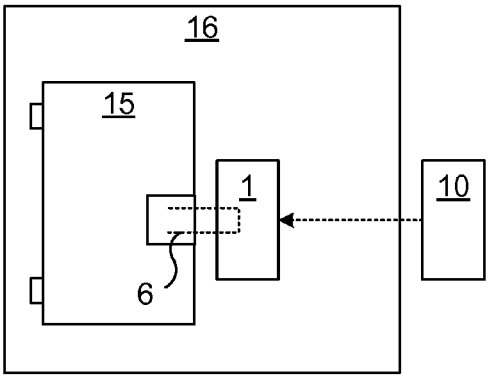
FIG. 1 is a schematic diagram showing an environment in which embodiments presented herein can be applied.

FIG. 1 is a schematic diagram showing an environment in which embodiments presented herein can be applied.

In this example, there is a door 15 which mechanically interacts with a lock device 1 using a mechanical interface 6, such as a bolt. A key device 10 can interact with the lock device 1, after which the lock device 1 determines whether to grant access, and the lock device 1 is set in an open state when access is granted. When the lock device 1 is in an open state, the door can be opened and when the lock device 1 is in a closed state, the door cannot be opened. In this way, access to a closed space 16 is controlled by the lock device 1. It is to be noted that the lock device 1 can be located in a fixed structure by the door the door frame (as shown) or in the door 15 (not shown).

Figure 2A:
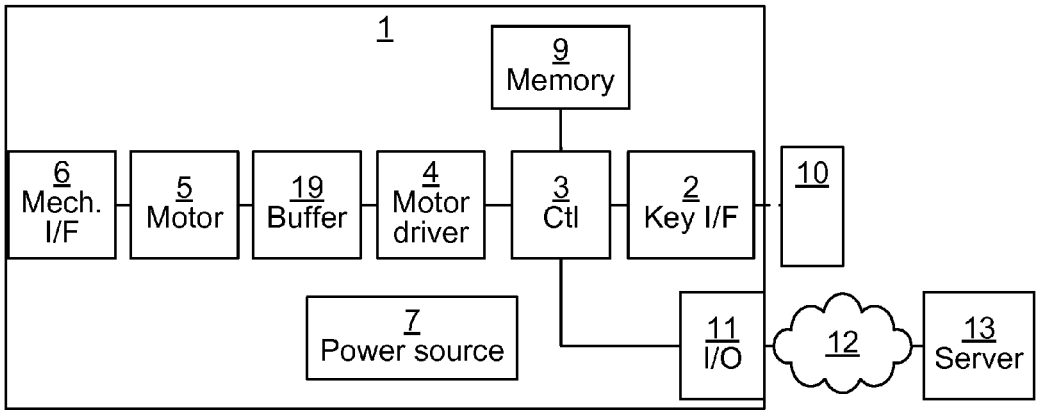
FIGS. 2A-B are schematic diagrams of the lock device of FIG. 1 according to various embodiments.
Figure 2B:
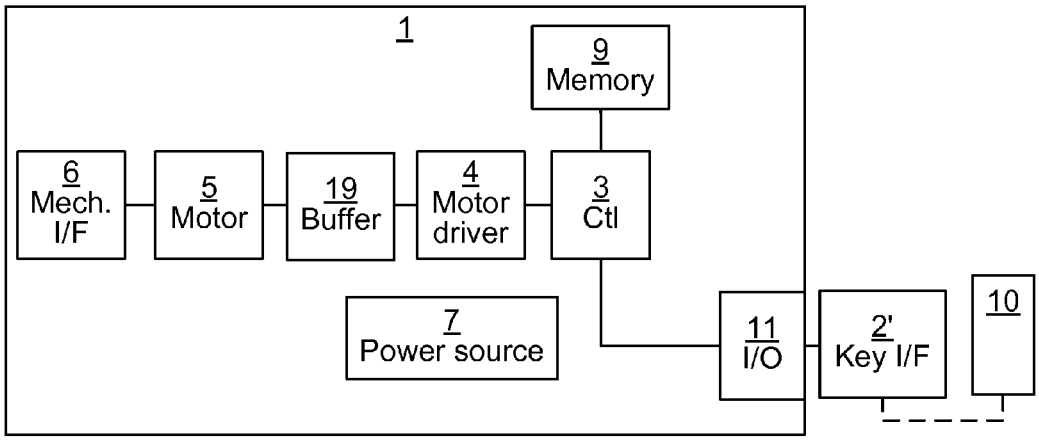

FIGS. 2A-B are schematic diagrams of the lock device of FIG. 1 according to various embodiments. The embodiment shown in FIG. 2A will be described first. A controller 3 is configured to determine whether to open the lock device 1. The controller 3 can be any combination of one or more of a suitable central processing unit (CPU), multiprocessor, microcontroller unit (MCU), digital signal processor (DSP), application specific integrated circuit etc., capable of executing software instructions or otherwise controllable to behave according to predetermined logic. A memory 9 can comprise persistent storage for storing a computer program comprising program code. In one embodiment, the program code, when executed by the controller, causes the lock device to determine whether to open the lock device. Moreover, the program code may, when executed by the controller, cause the lock device to provide an open signal when the lock device it to be opened, the open signal being a pulsating signal with a duty cycle which is less than a threshold duty cycle.

The controller 3 can e.g. receive credential data from a key interface 2. In this way, the controller determines whether to open the lock device for a particular key device 10 communicating with the key device interface 2, e.g. via radio frequency (such as RFID (Radio Frequency Identification and/or NFC (Near Field Communication), BLE (Bluetooth Low Energy) or using a galvanic connection. The credentials can be checked locally, e.g. checking against credential data in the memory 9. The memory 9 may also comprise persistent storage storing a computer program with software instructions for performing the methods described below.

Alternatively or additionally, the controller communicates using an input/output device 11 (optionally integrated as part of the controller 3) over a network 12, such a local area network or the Internet, with a server 13 to check the credential data.

Based on the credential data, the controller 3 determines whether to open the lock device 1 or not. If the lock device 1 is not to be opened, no action needs to be performed and the lock device 1 remains in a closed state. Optionally, user feedback is provided to inform of the denied access, e.g. by lighting a red light emitting diode (LED) (not shown) and/or displaying a message on a screen. If the lock device 1 is to be opened, the controller provides an open signal to a motor driver 4.

The open signal is a pulsating signal. This means that the open signal varies over time. The pulsating signal can e.g. be a square wave signal such as a pulse width modulated signal or a sinusoidal signal. The motor driver 4 comprises a capacitor providing a capacitive coupling between the controller 3 and the motor 5. The capacitive coupling is provided between an input and an output of the motor driver 4 prevents a pure direct current (DC) signal on the input from reaching the output. The motor driver 4 is thus configured to provide a motor control signal to the motor 5 to set the lock device in an open state based on the pulsating open signal. Using the capacitive coupling, the motor driver 4 can only engage the motor 5 if the open signal from the controller 3 is a pulsating signal. The open signal can e.g. be generated by firmware in the controller 3. Moreover, the open signal needs to have a duty cycle which is less than a threshold duty cycle for the motor driver to produce a suitable motor control signal to the motor (via the buffer 19).

Even if the input signal to the motor driver cannot be a pure DC signal to generate the motor control signal, the motor control signal from the motor driver 4 to the motor 5 can itself be a DC signal, which may be but does not need to have a constant voltage. In other words, the output signal of the motor driver 4 can be a signal which varies slightly but is over a threshold DC voltage. In one embodiment, the motor 5 requires a DC signal to operate. Once the motor 5 is provided with the motor control signal, it is activated and can thereby move a mechanical interface 6, such as the bolt to set the lock device in an open state. The motor 5 can e.g. be a DC motor or an alternating current motor. DC motors can be made small and at low cost.

Optionally, a buffer circuit 19, such as an amplifier, is provided between the motor driver 4 and the motor. The purpose of the buffer circuit 19 is to amplify the motor control signal provided to the motor, since the output impedance of the motor driver 4 can be significantly higher than the input impedance of the motor. In one embodiment, the buffer circuit 19 is an H bridge of four transistors, such as MOSFETs (Metal Oxide Semiconductor Field Effect Transistors). The buffer 19 is arranged such that the motor control signal from the motor driver 4 controls its operation. When activated, the buffer 19 provides power from a power source 7 to drive the motor.

The lock device 1 is powered by the power source 7. The power source 7 can e.g. comprise one or more batteries or a connection to a mains AC power, e.g. via an AC/DC (Alternating Current/Direct Current) converter (rectifier). Alternatively or additionally, the power source 7 includes the use of power harvesting, e.g. using solar cells, mechanical to electrical conversion of a door handle, etc. The power source 7 may be provided internally or externally from the lock device 1.

Using the capacitive coupling of the motor driver 4, even if the controller 3 were to fail and e.g. get stuck in a constant high signal which in itself would operate the motor, this would not be propagated to the motor 5 and the lock device 1 would remain in a safe closed state, thereby not compromising the security of physical space secured by the lock device.

Looking now to FIG. 2B, most components are the same as described with reference to FIG. 2A and will not be explained again. Here, however, the key device interface 2' is provided outside the lock device 1. The key device interface 2' then communicates via the input/output device 11 with the controller 3. The credential check can occur in either the key device interface 2' or the controller 3.

Figure 3:
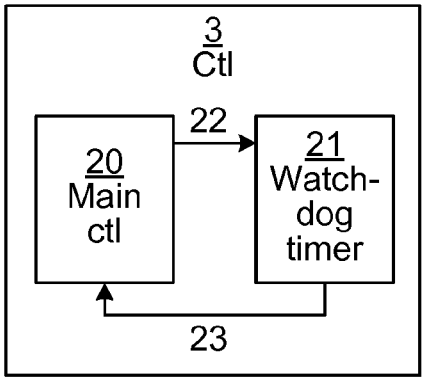
FIG. 3 is a schematic diagram of the controller of the lock device of FIGS. 2A-B according to one embodiment.

FIG. 3 is a schematic diagram of the controller 3 of the lock device 1 of FIGS. 2A-B according to one embodiment. The controller comprises a main controller 20 (a main part of the controller 20) and a watchdog timer 21. The main controller 20 is the part of the controller 3 that performs the main functions of the controller 3, e.g. determining whether to send an open signal to the motor driver and generating the pulsating signal forming part of the open signal. Periodically, the main controller 20 sends a restart timer signal 22 to the watchdog timer 21 prior to the watchdog timer expires. In this way, in normal operation, the watchdog timer 21 never expires. However, if a fault occurs and the main controller fails to keep sending the restart timer signals 22, the watchdog timer will expire. Once the watchdog timer expires, the watchdog timer 21 sends a reset signal 23 to reset the main controller 20. In many cases, this reset signal 23 is sufficient to make the main controller 20 operational again.

However, if the main controller 20 fails, the controller 3 is unable to send any pulsating open signal to the motor driver 4. In this way, the lock device 1 would remain in a closed state.

Figure 4:
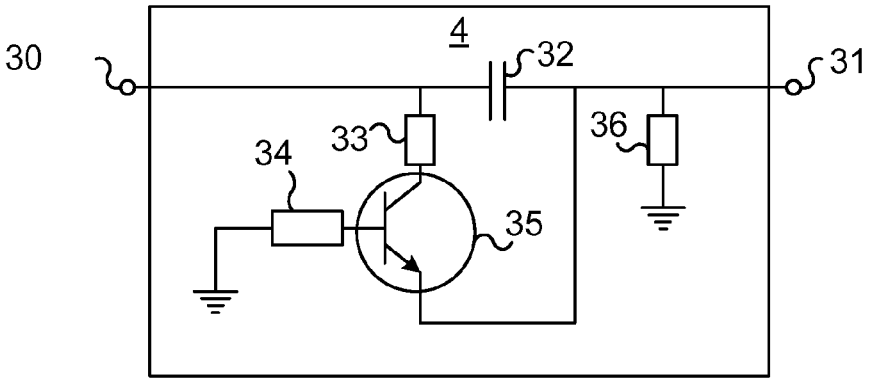
FIG. 4 is a schematic diagram of the motor driver of the lock device of FIGS. 2A-B according to one embodiment.

FIG. 4 is a schematic diagram of the motor driver 4 of the lock device 1 of FIGS. 2A-B according to one embodiment. The motor driver 4 has an input 30 and an output 31. There is a capacitor 32 between the input 30 and the output 31, providing a capacitive coupling which prevents a pure DC signal on the input 30 to propagate to the output 31. Moreover, there is a transistor 35 connected on its collector side (via a first resistor 33) to the input side of the capacitor 32. The emitter of the transistor 35 is connected to the output side of the capacitor 32. The base of the transistor 35 is connected to ground, via a second resistor 34. On the output side of the capacitor 32, there is a connection to ground via a third high-ohmic resistor 36.

A function of the transistor 35 is to quickly discharge the capacitor 32 and thus hold the DC level on the output 31 at about the same as the input 30. When the voltage on the input 30 falls, the voltage on the output 31 also falls. If the output voltage falls below about −0.6V, the transistor 35 conducts and discharges the capacitor 32. The purpose of the first resistor 33 is to limit the current through the transistor 35 within its operating range. In one embodiment, the first resistor 33 is omitted and instead it is sufficient with proper dimensioning of the second resistor 34, since the current to the base of the transistor 35 controls the main current through the transistor (between collector and emitter). An advantage with the transistor 35 is that the controller 3 usually has relatively high current rating, i.e. low impedance. In one embodiment (not shown), a diode is provided in parallel with the third resistor 36 with the anode connected to ground. In such an embodiment, the transistor 35, first resistor 33 and second resistor are omitted.

When the signal provided on the input 30 stops to pulsate (i.e. vary over time), the transistor 35 is turned off and resistor 36 will pull output 31 to ground.

The motor driver 4 of FIG. 4 is only an example and the motor driver 4 can be implemented using any suitable structure as long as there is a capacitor provided between the input and output to thereby provide the capacitive coupling which prevents a pure DC signal from passing through the motor driver 4.

Figure 5A:
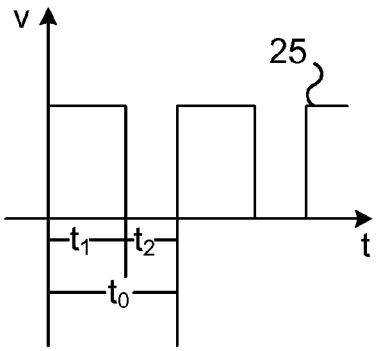
FIGS. 5A-B are schematic graphs illustrating input and output voltages of the motor driver 4 when the lock device is to be opened according to one embodiment.
Figure 5B:
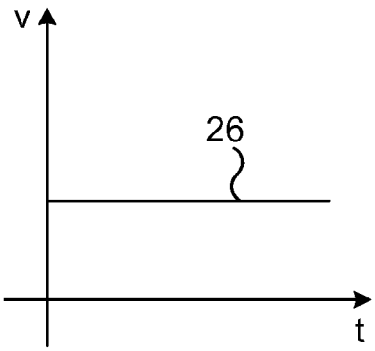

FIGS. 5A-B are schematic graphs illustrating input and output voltages of the motor driver 4 when the lock device is to be opened according to one embodiment. FIG. 5A shows an open signal 25 being a pulsating signal. In this example, the open signal 25 is a PWM signal with a period of $t_0$. In each period, there is a high voltage signal of a first duration $t_1$ and a low voltage signal (or zero voltage signal) of a second duration $t_2$. The duty cycle of the open signal is defined as the portion of a period in which the signal is high, i.e. $t_1/t_0$.

FIG. 5B shows an ideal output signal of the motor driver 4 of FIGS. 2A-B when a pulsating signal is provided on the input of the motor driver. The output signal 26 is then a DC signal. It is to be noted that in reality, a ripple often occurs on the output signal 26, even if it generally stays positive.

Figure 6A:
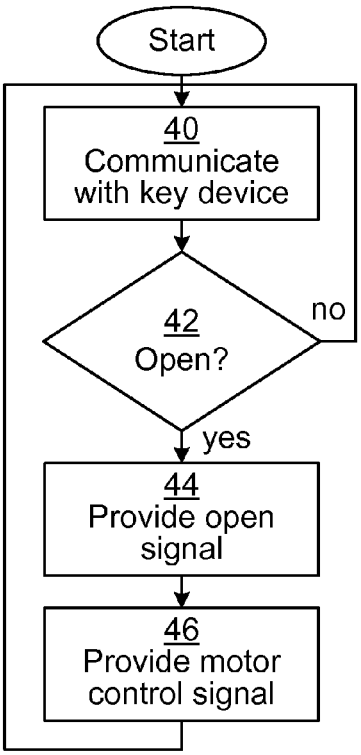
FIGS. 6A-C are flow charts illustrating methods according various embodiments performed in the lock device of FIGS. 1-2.
Figure 6B:
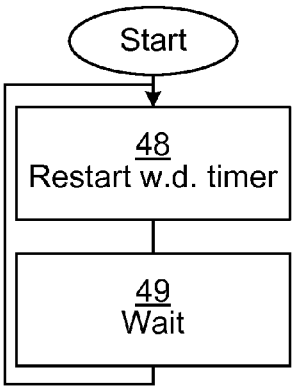
Figure 6C:
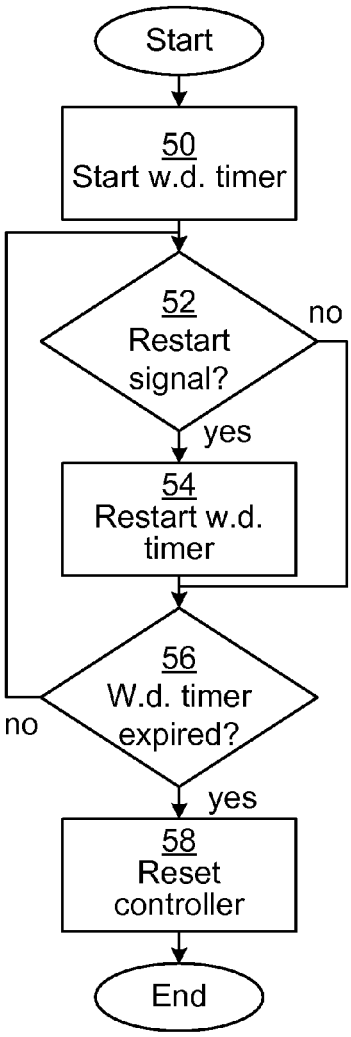

FIGS. 6A-C are flow charts illustrating methods according various embodiments performed in the lock device of FIGS. 1-2. The method is performed to controllably open the lock device.

In an optional communicate with key device step 40, the lock device communicates with a key device using the key device interface (see 2 of FIG. 2A).

In a conditional open step 42, it is determined whether to open the lock device. If it is determined to open the lock device, the method continues to a provide open signal step 44. Otherwise, the method returns to the communicate with key device step 40. This step may involve receiving a signal to open from a device which verifies credentials of a key device or performing the check of the credentials of a key device.

In the provide open signal step 44, the open signal is provided to the motor driver.

In the provide motor control signal step 46, a motor control signal is provided to the motor to set the lock device in an open state only when a duty cycle of the open signal is less than a threshold duty cycle.

FIG. 6B is a flow chart illustrating a method performed in the main controller (20 of FIG. 3) of the controller of the lock device 1 of FIG. 1.

In a restart watchdog timer step 48, the restart timer signal (22 of FIG. 3) is sent to the watchdog timer to restart the timer.

In a wait step 49, the method waits for a certain period, after which the method returns to the restart watchdog timer step 48.

In this way, the watchdog timer is periodically restarted as long as the main controller of the controller operates normally. This method may be performed separately from other tasks of the main controller.

FIG. 6C is a flow chart illustrating a method performed in the watchdog timer (21 of FIG. 3) of the controller of the lock device 1 of FIG. 1.

In a start watchdog timer step 50, the watchdog timer is started.

In a conditional restart signal step 52, it is determined whether a restart timer signal (22 of FIG. 3) has been received, typically from the main controller. If a restart timer signal has been received, the method proceeds to a restart watchdog timer step 54. Otherwise, the method proceeds to a conditional watchdog timer expired step 56.

In the conditional watchdog timer expired step 56, it is determined whether the watchdog timer has expired. If this is the case, the method proceeds to a reset controller step 58. Otherwise, the method returns to the conditional restart signal step 52, optionally via a wait step (not shown).

In the reset controller step 58, the main controller is reset as explained above in order to set the controller in an operational state.

Figure 7:
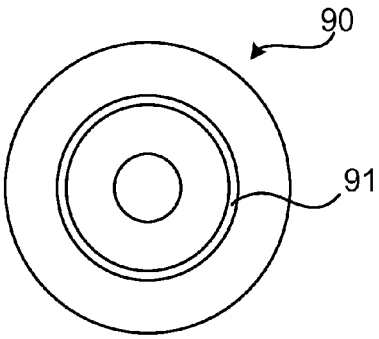
FIG. 7 is a schematic diagram showing one example of a computer program product comprising computer readable means.

FIG. 7 is a schematic diagram showing one example of a computer program product 90 comprising computer readable means. On this computer readable means a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the memory 9 of FIGS. 2A-B. While the computer program 91 is here schematically shown as a track on the depicted optical disk, the computer program can be stored in any way which is suitable for the computer program product.

Figure 8:
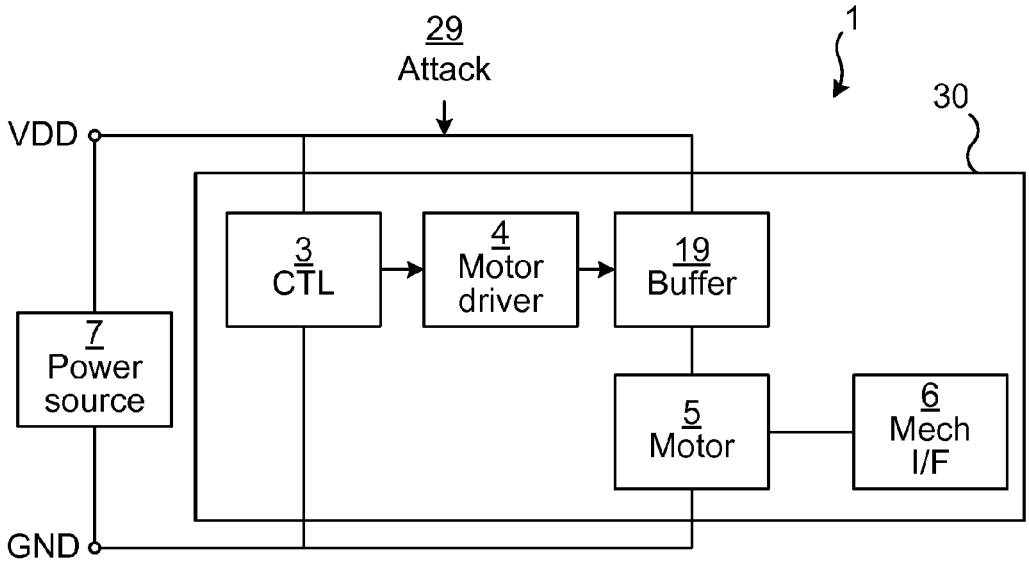
FIG. 8 is a schematic diagram illustrating the lock device 1 according to one embodiment.

FIG. 8 is a schematic diagram illustrating the lock device 1 according to one embodiment. Here, the power supply 7 can be seen, providing DC power with a positive pole VDD and a ground pole GND. An internal housing 30 comprises the controller 3, the motor driver 4, the buffer 19, the motor 5 and the mechanical interface 6. Optionally, there are more components of the lock device 1 within the internal housing 30. The internal housing 30 is installed in a secure space, such as in the door 15 or surrounding space around the door, where access to the components inside the internal housing 30 are inaccessible when the lock is in a locked (and closed) state. For instance, the internal housing 30 can be installed such that it is only exposed when a door, for which access is controlled by the lock device, is open.

The power supply 7, however, does not need to be installed in a secure space. While this does expose an interface to attack 29 the lock device via VDD and GND, the attacker will not be able to activate the motor through this interface as will now be explained. When an attack 29 is performed, this can e.g. comprise an overvoltage on VDD. The purpose of such an attack is to destroy the controller 3, which can put the controller in a blocking state or a short-circuit state.

In the blocking state, the controller 3 blocks any output from the controller 3. Since no signal from the VDD reaches the motor driver 4, the attack 29 is unsuccessful regardless of the signal provided on VDD.

In the short-circuit state, the controller 3 passes the signal on VDD to the motor driver 4. In this way, if the attacker knows of the structure of the motor driver 4, including the capacitive coupling, the attack 29 can involve a pulsating signal, such as a PWM signal on VDD. When performed with the correct frequency, the attack signal on VDD can mimic an open signal from the controller 3. In such a case, the motor control signal from the motor driver to the buffer 19 will activate the buffer 19. When the buffer 19 is activated, it passes power from VDD to the motor 5.

In one way, the attack 29 is successful in that power is now passed to the motor 5. But since the power on VDD during the attack is a pulsating signal, a duty cycle less than 100% is provided to the motor 5. More specifically, the motor driver 4 is designed such that it requires an open signal with a duty cycle less than a threshold to provide the motor control signal. Significantly, the threshold is selected such that a VDD with a duty cycle less than the threshold duty cycle is not sufficient to drive the motor 5. Hence, the attack signal 29 needs to have a duty cycle of less than the threshold to generate the motor control signal. However, the attack signal 29, which is then also fed to the motor 5, is not sufficient to drive the motor.

In this way, the power interface (VDD, GND) can be exposed while still preventing an attack 29 from activating the motor 5 of the lock device.

Figure 9:
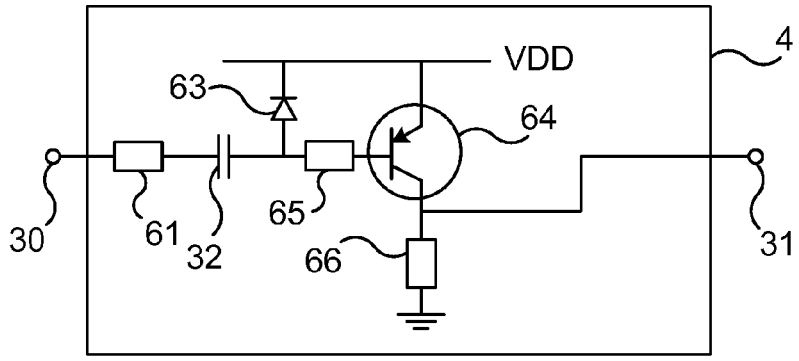
FIG. 9 is a schematic diagram of the motor driver 4 of lock device 1 of FIGS. 2A-B according to one embodiment.

FIG. 9 is a schematic diagram of the motor driver 4 of the lock device 1 of FIGS. 2A-B according to one embodiment. The motor driver 4 has an input 30 and an output 31. There is a capacitor 32 between the input 30 and the output 31, providing a capacitive coupling which prevents a pure DC signal on the input 30 to propagate to the output 31. Moreover, there is a transistor 64 (in this case a PNP transistor) connected on its emitter side to VDD and on its collector side via a fourth resistor 66 to ground. A fifth resistor 61 and a sixth resistor 65 are provided on either side of the capacitor 32. The base of the transistor 35 is connected to the input (via the sixth resistor 65, the capacitor 32 and the fifth resistor 61). A diode 63 is provided from the capacitor 32 to VDD to lead off any excess voltage. The output of the motor driver 4 is connected to the collector of the transistor 64.

The transistor 64 conducts only when the signal on the input 30 is negative, but the motor is only given power when VDD is positive. Thus, one function of this motor driver 4 is to act as an inverter, such that the signal on the output 31 is the inverse of the signal on the input. Hence, a low signal on the input 30 results in a high signal on the output 31 and vice versa.

In this way, if an attacker provides a pulsating signal on VDD, when the pulsating signal is low, the motor driver 4 conducts but no power is transferred to the motor since VDD is low. On the other hand, when the attack signal on VDD is high, the energy is still not provided to the motor from VDD since the transistor of the motor driver 4 enters a blocking state, providing a low signal on the output 31. The motor control signal to the buffer is then low, whereby the buffer prevents power from VDD to be transferred to the motor.

However, with the controller 3 providing an open signal with low duty cycle on the input 30, a large amount of power will be transferred from VDD via the buffer. In fact, the lower duty cycle is on the open signal is, the greater amount of power is transferred via the buffer. It is to be noted that when the lock device 1 is in normal operation (i.e. the controller 3 is functional), the VDD is unaffected by the open signal from the controller; the open signal from the controller to the motor driver 4 can have arbitrary duty cycle without affecting VDD (which is a high DC signal during normal operation).

Here now follows a list of embodiments from another perspective, enumerated with roman numerals.

i. A lock device comprising:

a controller configured to determine whether to open the lock device, wherein the controller is configured to provide an open signal when the lock device it to be opened, the open signal being a pulsating signal;

a motor controllable to set the lock device in an open state or a closed state; and a motor driver connected between the controller and the motor, the motor driver comprising a capacitor providing a capacitive coupling between the controller and the motor, to thereby provide a motor control signal to the motor to set the lock device in an open state based on the open signal.

ii. The lock device according to embodiment i, wherein the open signal is a pulse width modulated, PWM, signal.

iii. The lock device according to any one of the preceding embodiments, wherein the controller comprises a watchdog timer periodically restarted by a main part of the controller when in normal operational state, wherein the watchdog timer is configured to reset the controller when it expires.

iv. The lock device according to any one of the preceding embodiments, wherein the motor is a direct current motor.

v. The lock device according to any one of the preceding embodiments, wherein the lock device further comprises a key device interface; and wherein the controller is configured to determine whether to open the lock device for a key device communicating with the key device interface.

vi. The lock device according to embodiment v, wherein the key device interface comprises a radio frequency interface for communicating with key devices.

vii. The lock device according to embodiment v or vi, wherein the key device interface comprises a galvanic electrical connection for communicating with key devices.

viii. A method for opening a lock device, the method being performed in the lock device and comprising the steps of:

determining whether to open the lock device;

providing an open signal to a motor driver of the lock device when it is determined to open the lock device, the open signal being a pulsating signal; and providing a motor control signal to the motor to set the lock device in an open state based on the open signal.

ix. The method according to embodiment viii, wherein the open signal is a pulse width modulated, PWM, signal.

x. The method according to embodiment viii or ix, further comprising the steps of:

periodically restarting a watchdog timer when the controller is in a normal operational state; and resetting the controller when the watchdog timer expires.

xi. The method according to any one of embodiments viii to x, further comprising the step of:

communicating with a key device using a key device interface; and wherein the step of determining whether to open the lock device is based on the result of the communication with the key device.

xii. The method according to embodiment xi, wherein the step of communicating with a key device comprises the use of a radio frequency interface to the key device.

xiii. The method according to embodiment xi or xii, wherein the step of communicating with a key device comprises the use of a galvanic electrical connection with the key device.

xiv. A computer program for controlling access, the computer program comprising computer program code which, when run on a lock device, causes the lock device to:

communicate with a key device using a key device interface;

determine whether to grant access for the key device communicating with the key device interface;

when access is granted, provide an open signal to a motor driver of the lock device the open signal being a pulsating signal; and provide a motor control signal to the motor to set the lock device in an open state based on the open signal.

xv. A computer program product comprising a computer program according to embodiment xiv and a computer readable means on which the computer program is stored.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A lock device comprising:

a controller configured to determine whether to open the lock device, wherein the controller is configured to provide an open signal when the lock device it to be opened, the open signal being a pulsating signal;

a motor controllable to set the lock device in an open state or a closed state; and a motor driver connected between the controller and the motor, the motor driver comprising a capacitor providing a capacitive coupling between the controller and the motor, to thereby provide a motor control signal to the motor to set the lock device in an open state only when a duty cycle of the open signal is less than a threshold duty cycle and wherein a signal with the threshold duty cycle is insufficient to activate the motor.

2. The lock device according to claim 1, wherein the motor driver is configured such that a decreased duty cycle of the open signal results in an increased duty cycle of the motor control signal.

3. The lock device according to claim 1, wherein the open signal is a pulse width modulated, PWM, signal.

4. The lock device according to claim 1, wherein the controller comprises a watchdog timer periodically restarted by a main part of the controller when in normal operational state, wherein the watchdog timer is configured to reset the controller when it expires.

5. The lock device according to claim 1, wherein the motor is a direct current motor.

6. The lock device according to claim 1, wherein the lock device further comprises a key device interface; and wherein the controller is configured to determine whether to open the lock device for a key device communicating with the key device interface.

7. The lock device according to claim 6, wherein the key device interface comprises a radio frequency interface for communicating with key devices.

8. The lock device according to claim 6, wherein the key device interface comprises a galvanic electrical connection for communicating with key devices.

9. A method for opening a lock device, the method being performed in the lock device and comprising the steps of:

determining whether to open the lock device;

providing an open signal to a motor driver of the lock device when it is determined to open the lock device, the open signal being a pulsating signal; and providing a motor control signal to the motor to set the lock device in an open state only when a duty cycle of the open signal is less than a threshold duty cycle and wherein a signal with the threshold duty cycle is insufficient to activate the motor.

10. The method according to claim 9, wherein the open signal is a pulse width modulated, PWM, signal.

11. The method according to claim 9, further comprising the steps of:

periodically restarting a watchdog timer when the controller is in a normal operational state; and resetting the controller when the watchdog timer expires.

12. The method according to claim 9, further comprising the step of:

communicating with a key device using a key device interface; and wherein the step of determining whether to open the lock device is based on the result of the communication with the key device.

13. The method according to claim 12, wherein the step of communicating with a key device comprises the use of a radio frequency interface to the key device.

14. The method according to claim 12, wherein the step of communicating with a key device comprises the use of a galvanic electrical connection with the key device.

15. A computer program for controlling access, the computer program comprising computer program code which, when run on a lock device, causes the lock device to:

communicate with a key device using a key device interface;

determine whether to grant access for the key device communicating with the key device interface;

when access is granted, provide an open signal to a motor driver of the lock device the open signal being a pulsating signal; and provide a motor control signal to the motor to set the lock device in an open state only when a duty cycle of the open signal is less than a threshold duty cycle and wherein a signal with the threshold duty cycle is insufficient to activate the motor.

16. A computer program product comprising a computer program according to claim 15 and a computer readable means on which the computer program is stored.

* * * * *